United States Patent [19]

Yamada et al.

[11] 4,421,615

[45] Dec. 20, 1983

[54] PROCESS FOR PRODUCING METALLIC GALLIUM

[75] Inventors: Koichi Yamada; Takuo Harato, both of Niihama; Yasuo Shinya, Seto; Hisakatsu Kato, Niihama, all of Japan

[73] Assignees: Sumitomo Aluminium Smelting Company, Limited; Sumitomo Chemical Company, Ltd., both of Osaka, Japan

[21] Appl. No.: 421,838

[22] Filed: Sep. 23, 1982

[30] Foreign Application Priority Data

Sep. 30, 1981 [JP] Japan ..... 56-156467

[51] Int. Cl.[3] ..... C25G 1/00

[52] U.S. Cl. ..... 204/105 R; 210/714; 210/723; 210/737; 210/749; 210/758; 210/763; 210/766; 210/767

[58] Field of Search ..... 204/105 R, 124; 210/714, 723, 737, 749, 758, 763, 766, 767

[56] References Cited

U.S. PATENT DOCUMENTS

| | | | |
|---|---|---|---|
| 2,582,377 | 1/1952 | Brown et al. | 204/105 R |
| 2,582,378 | 1/1952 | Brown et al. | 204/105 R |
| 2,793,179 | 5/1957 | Breteque | 204/105 R |
| 4,135,917 | 1/1979 | Badaliants et al. | 204/105 R |
| 4,152,227 | 5/1979 | Badaliants et al. | 204/205 R |
| 4,362,606 | 12/1982 | Sinka et al. | 204/105 R |

*Primary Examiner*—R. L. Andrews

*Attorney, Agent, or Firm*—Stevens, Davis, Miller & Mosher

[57] ABSTRACT

A highly efficient process for producing metallic gallium from a gallium containing alkali aluminate solution circulating in the Bayer process is disclosed. The process comprises subjecting an alkali aluminate solution to electrolysis, said solution being obtained by (1) cooling an alkali aluminate solution after the aluminum hydroxide separation step in the Bayer process in the presence or absence of at least one, as a seed, alkali salt of an element selected from vanadium and phosphorus, or complexes containing the alkali salt, in order to precipitate crystals of impurities containing vanadium, phosphorus, etc. in the solution; removing the precipitates; and then subjecting the resulting alkali aluminate solution to oxidation treatment; or by (2) subjecting an alkali aluminate solution after the aluminum hydroxide separation step in the Bayer process to oxidation treatment; cooling the resulting liquor in the presence or absence of at least one, as a seed, alkali salt of an element selected from vanadium and phosphorus, or complexes containing the alkali salt, in order to precipitate crystals of impurities containing vanadium, phosphorus, etc. in the liquor; and then removing the precipitates.

5 Claims, 1 Drawing Figure

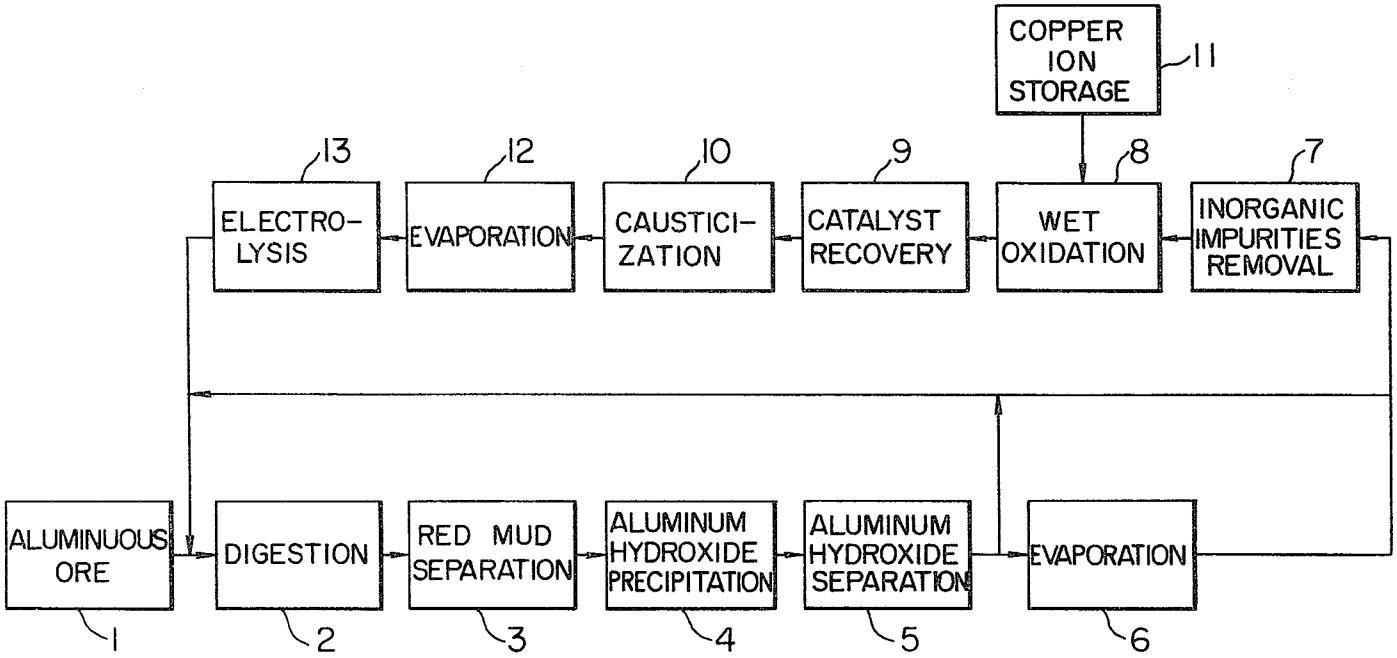
ALUMINUOUS ORE
1
DIGESTION
2
RED MUD SEPARATION
3
ALUMINUM HYDROXIDE PRECIPITATION
4
ALUMINUM HYDROXIDE SEPARATION
5
EVAPORATION
6
INORGANIC IMPURITIES REMOVAL
7
WET OXIDATION
8
CATALYST RECOVERY
9
CAUSTICI-ZATION
10
COPPER ION STORAGE
11
EVAPORATION
12
ELECTRO-LYSIS
13

PROCESS FOR PRODUCING METALLIC GALLIUM

The present invention relates to a process for producing metallic gallium in high yield in a very economical and simple manner from an alkali (e.g. sodium) aluminate solution which is recyclically used in production of alumina from aluminum ores (e.g. bauxite) by the Bayer process or an improved process thereof.

Gallium is widely distributed in the earth's crust, but there is no specific ore therefor.

Gallium resembles aluminum in its properties, dissolves together with alumina in production of alumina according to alkali digesting of bauxite by the Bayer process, and is accumulated in the circulating alkali aluminate solution in a concentration of, in general, 0.1–0.3 g/l during the recyclic use of the alkali aluminate solution. Therefore, production of metallic gallium in an industrial scale is currently conducted primarily by using this Bayer liquor.

An alkali aluminate solution separated at the aluminum hydroxide precipitation step of the Bayer process contains, in general, 50–500 mg/l vanadium, 50–500 mg/l phosphorus and 5–30 g/l organic carbon as impurities. When the aluminate solution is subjected to electrolysis for depositing gallium, these impurities interupt its electrolytical deposition. As a result, the electricity (power) requirement is greatly increased and gallium may not be deposited at all. Therefore, conventional production of metallic gallium from an alkali aluminate solution containing gallium has been conducted according to one of the following methods:

(1) A circulating sodium aluminate solution in the Bayer process is cooled to precipitate impurities such as vanadium, the impurities are removed, and the resulting solution is electrolysed using a stirred mercury cathode to deposit gallium as a gallium amalgam. The amalgam is decomposed with an alkali liquor to obtain an alkali gallate, and metallic gallium is recovered by electrolysis of the alkali gallate using a solid electrode such as a stainless steel electrode (U.S. Pat. No. 2,793,179).

(2) A circulating sodium aluminate solution in the Bayer process is contacted with the sodium amalgam obtained by electrolysis of a sodium chloride solution using mercury as a cathode to fix gallium thereto as gallium amalgam, and the amalgam is decomposed with an alkali liquor to obtain an alkali gallate liquor. Then, the liquor is subjected to electrolysis using a solid electrode to recover metallic gallium (West German Patent No. 1,260,791).

(3) An acidic compound such as carbon dioxide and carbonic acid is added to a circulating sodium aluminate solution in the Bayer process to precipitate most of the aluminum in the solution as aluminum hydroxide which is then separated off, or a calcium compound is added to the aluminate solution to precipitate most of the aluminum in the solution as calcium aluminate which is then separated off, whereby the ratio of gallium to aluminum in the resulting solution is raised. Then, the acidic compound is again added to the solution to coprecipitate hydrated gallium oxide and aluminum hydroxide, the coprecipitate is calcined and then dissolved in an alkali solution, and the resulting solution is subjected to electrolysis (U.S. Pat. Nos. 2,582,376 and 2,582,377).

Thus, according to the prior art processes, gallium is first converted to another compound, and then this compound is treated with an alkali solution and electrolysed.

However, the prior art processes have disadvantages such as the fact that expensive reagents and complicated treating steps are required. Moreover it is impossible to recyclically use the sodium aluminate solution after recovery of gallium in the Bayer process or, if possible, it requires a great deal of treating costs.

Under these circumstances, the present inventors have energetically studied in order to find a very economical and simple process for producing gallium. As a result of these studies, they have found that when specific steps in the various conventional processes for purifying a circulating alkali aluminate solution are combined, the circulating alkali aluminate solution obtained is usable as an electrolyte for recovering gallium without any specific treatment and is recyclically usable in the Bayer process without any specific treatment, as an alkali aluminate solution for extracting alumina from bauxite.

Thus, the present invention relates to a process for producing metallic gallium from a circulating alkali aluminate solution in the Bayer process containing gallium, which comprises subjecting the alkali aluminate solution to electrolysis, said solution being obtained by (1) cooling an alkali aluminate solution after the aluminum hydroxide separation step in the Bayer process in the presence or absence of at least one, as a seed, alkali salt of an element selected from vanadium and phosphorus, or complexes containing the alkali salt in order to precipitate crystals of impurities containing vanadium, phosphorus, etc. in the solution, which crystals are then removed, and then subjecting the resulting alkali aluminate solution to oxidation treatment; or by (2) subjecting an alkali aluminate solution after the aluminum hydroxide separation step in the Bayer process to oxidation treatment, and then cooling the resulting liquor in the presence or absence of at least one, as a seed, alkali salt of an element selected from vanadium and phosphorus, or complexes containing the alkali salt, in order to precipitate crystals of impurities containing vanadium, phosphorus, etc. in the liquor, which crystals are then removed.

The present invention is described in more detail below as to the case when a sodium aluminate solution as the alkali aluminate solution is used. The same procedure is applicable to the case when other alkali are used, e.g. potassium aluminate solution.

The circulating sodium aluminate solution used in the present invention is a solution that is obtained after precipitation of aluminum hydroxide in the Bayer process (the solution will be hereinafter referred to as a spent liquor) and contains impurities such as organic matters and inorganic matters, e.g. phosphorus, vanadium. Preferably, the solution is a circulating sodium aluminate solution obtained after the precipitation and subsequent evaporation step in the Bayer process, wherein the sodium aluminate solution is concentrated after passing through the precipitation step.

According to the present invention, the spent liquor is first cooled in the presence or absence of at least one, as a seed, sodium salt of an element selected from vanadium and phosphorus, or complexes containing the sodium salt in order to precipitate crystals of inorganic impurities in the liquor, which crystals are then removed.

The equilibrium concentration of impurities in a spent liquor decreases in proportion to any increase in sodium concentration. Therefore, the spent liquor, after precipitation and separation of aluminum hydroxide, is evaporated and cooled to make the sodium concentration, in terms of $Na_2O$ to 100–400 g/l. The resulting spent liquor is then cooled in the presence or absence of the seed crystals to precipitate impurities such as organic matters and inorganic matters, e.g. vanadium and phosphorus in the solution, which impurities are then removed.

In the present invention, precipitation of the impurities is conducted in general at a temperature of 0°–75° C., preferably 10°–60° C. Since the equilibrium concentration of the impurities in the spent liquor decreases in proportion as the temperature is lowered, it is preferred to adopt a low temperature. Precipitation time depends upon the presence of a seed and the seed amount. The the spent liquor is stirred for one day or more, preferably 2–4 days in the absence of a seed; and for 10 minutes or more in general, and preferably 30 minutes -24 hours in the presence of a seed.

When a sodium salt of an element selected from vanadium and phosphorus, or a complex containing such a sodium salt, is introduced into the spent liquor, the amount is, in general, about 30 weight % or more based on that of vanadium + phosphorus, preferably about 50–50,000 weight %. It is undesirable, because of reduced seed effect that the amount of the sodium salt, the complex or a mixture thereof is less than 30 weight %. The upper limit of the seed concentration is determined by economic considerations. When the sodium salt or complex or a mixture thereof is added as a solution to the spent liquor, it is desirable that after the addition the spent liquor has a supersaturation degree of the impurities:

$$\left(\frac{\text{concentration of impurity} - \text{equilibrium concentration of impurity}}{\text{equilibrium concentration of impurity}}\right)$$

of 0.5 or more, preferably 1 or more.

Thus, concentration of the impurities in the sodium aluminate solution is lowered approximately to its equilibrium concentration, and impurities are precipitated on the seed crystals when a seed is used, or are precipitated to form new crystals in the case when no seed is used. These crystals of the impurities are separated from the aluminate solution by a conventional solid-liquid separation technique such as settling, filtration and centrifugation.

A portion of the crystals obtained by the solid-liquid separation, after washing the surface, is recyclically usable as a seed for precipitating impurities.

By means of the precipitation by the cooling, the amount of inorganic impurities such as vanadium and phosphorus in the spent liquor is adjusted to 450 mg/l or less in general, preferably 200 mg/l or less.

The spent liquor after removal of the inorganic impurities is then subjected to removal of organic matters, composed mainly of humic matters, contained in the solution by oxidation-decomposition. A conventional oxidation-decomposition method, such as a method using an oxidizing agent, e.g. potassium dichromate, potassium permanganate and hydrogen peroxide, is applicable to the oxidation-decomposition of the organic matters without specific limitation, but from the viewpoint of economics and the fact that the sodium aluminate solution after the treatment is recycled in the Bayer step, the following wet oxidation treatment is preferable:

(1) The sodium aluminate mother liquor is contacted with a molecular oxygen gas under a pressure sufficient to convert the organic matters in the mother liquor to oxalates, which are then removed from the mother liquor (Japanese Patent Publication 30458/70); or (2) A circulating sodium aluminate solution containing organic matters is contacted with oxygen or an oxygen-containing gas in an amount proportional to that of the matters to be oxidized in the presence of copper ion at a temperature of 180° to 350° C. under conditions designed to keep the solution at least partially in a liquid state (Japanese Patent Publication No. 110199/79).

The second procedure (2) which has a high removal efficiency of the organic matters and a beneficial effect in that during the recovery of copper ion from the solution other impurities are removed at the same time, is appropriate for producing gallium in good efficiency.

In oxidation of organic matters such as humic matters in the sodium aluminate solution according to the procedure (2), first, the aluminate solution is introduced in the step of the wet oxidation treatment, and subjected to oxidation in the presence of copper ion at a temperature of 180°–350° C. under a pressure of 20–150 kg/cm$^2$ under conditions designed to keep the solution at least partially in a liquid state.

The amount of copper ion introduced into the solution is 100 mg/l or more in general, preferably 300–5000 mg/l, and when the amount is lower than 100 mg/l, the effect achieved by the addition is small and the treatment takes a long time.

On the other hand, when the amount of copper ion added is more than 5000 mg/l, an effect corresponding to the added amount is not obtained, and thus the upper limit of the amount added is determined by economic considerations.

Compounds offering copper ion are exemplified by water soluble cupric salts such as cupric sulfate, cupric nitrate and cupric chloride, cupric sulfide which is usually water-insoluble but becomes water-soluble in an atmosphere of the wet oxidation treatment, etc.

It is undesirable for the temperature of the wet oxidation treatment to be below 180° C., because the decomposition of the organic matters in the liquor to be treated is inadequate or it takes a long time for the treatment to be completed. On the other hand, it is also undesirable that the temperature be more than 350° C., because corrosion of the apparatus is considerable, due in part to the strongly alkaline nature of the liquor to be treated.

Molecular oxygen or a molecular oxygen-containing gas is used as a gas for the oxidation treatment, and above all air is preferable due to its economics. The amount of the gas to be supplied is a theoretical amount necessary for oxidizing almost all of the organic matters contained in the liquor to be treated and making them harmless, or more.

The compound supplying copper ions remains in the sodium aluminate solution after the wet oxidation treatment. When the liquor after the oxidation is subjected to electrolysis without treatment by copper ions, the electrolytical efficiency of gallium deposition is greatly lowered. Further, when the liquor after the electrolysis is recycled in the Bayer process, copper compounds are coprecipitated with aluminum hydroxide at the precipitation step of aluminum hydroxide thereby lowering the purity of the aluminum hydroxide, and at the same time resulting in a loss of expensive copper ion-offering compound. Therefore, it is preferable to utilize a step for recovering the copper ion-offering compound.

In the step for recovering the copper ion-offering compound, a compound, which reacts with copper ion in the sodium aluminate solution after the oxidation treatment to form an insoluble compound, is added to the solution. Such a compound is exemplified by sulfides such as sodium sulfide and hydrogen sulfide, and the amount to be added is an amount stoichiometrical to the amount of copper ion supplied for the oxidation treatment, or more, preferably 2 to 3 times the stoichiometrical amount. In the recovery step, the sulfide reacts with copper ion to form and precipitate an insoluble substance consisting mainly of copper sulfide. The precipitate is separated by a conventional solid-liquid separation method such as settling, filtration and centrifugation. The separated precipitate can be reused either after being subjected to oxidation in an oxidation step or by directly introducing it in the wet oxidation treatment step.

Copper ion as well as other impurities in the sodium aluminate solution are precipitated by the addition of the sulfide. The precipitate is then separated. Thus, the copper ion addition treatment has a significant beneficial effect on the production of gallium.

Further, as the sodium aluminate solution after the oxidation treatment is lowered in caustic $Na_2O$ concentration and therefore aluminum hydroxide concentration in the solution is in a supersaturation state, it is possible to recover aluminum hydroxide by adding seed crystals of aluminum hydroxide thereto. According to the recovery operation, in addition to recovery of aluminum hydroxide, precipitation of aluminum hydroxide in the electrolysis operation is prevented and impurities in the solution are removed. Therefore, it is desirable to conduct the recovery operation.

The sodium aluminate solution after the oxidation decomposition and solid-liquid separation is usable as it is for the electrolysis treatment, but it is desirable that the solution is subjected to causticization treatment before the electrolysis. That is, carbonate and sulfate are formed and gradually accumulated in the liquor during the wet oxidation, and they lower the efficiency of gallium electrolysis. Further, when the liquor is recycled to the Bayer process as a circulating sodium aluminate solution, the accumulated carbonate and sulfate make the rate of aluminum hydroxide precipitation lower. Therefore, it is desirable to contact the aluminate solution after the oxidation-decomposition and solid-liquid separation with an alkaline earth material such as calcium hydroxide to precipitate carbonate and sulfate as insoluble salts such as calcium carbonate and calcium sulfate respectively and at the same time regenerate sodium hydroxide in the solution, that is to conduct causticization treatment.

The sodium aluminate solution thus obtained in a purified state containes 0.1–0.4 g/l gallium, 150 mg/l or less of vanadium, 100 mg/l or less of phosphorus, 15 g/l or less of organic carbon and trace of iron, etc., and usable as an electrolyte for recovering gallium by electrolysis.

The foregoing explanation of the embodiment of the present invention has been made with regard to the removal of inorganic impurities in the spent liquor by precipitation, removal of organic matters by oxidation-decomposition and causticization treatment. However, it is of course possible to cool the sodium aluminate solution after removal of organic matter by oxidation-decomposition and subsequent causticization treatment to precipitate the inorganic matters, and then to remove the inorganic matters.

The sodium aluminate solution thus purified is then subjected to the electrolytic treatment for recovery of gallium.

In the electrolytic treatment, as the gallium concentration in the aluminate solution as an electrolyte is increased, the current efficiency is improved and the power consumption is lowered. Therefore, it is desirable to concentrate the solution. However, when the concentration is too high, the viscosity of the electrolyte is raised and this makes handling difficult. Moreover, when the causticization treatment in the previous step is not conducted, or when the treatment is inadequate, sodium carbonate is in a supersaturation state due to the too high concentration and is precipitated, and separation thereof is difficult. Therefore, an evaporation ratio of 1 to 4, preferably 1 to 3 times, in order to make the caustic $Na_2O$ concentration after separation of sodium carbonate after evaporation to be 400 g/l or less, is appropriate from a practical standpoint.

Known methods are usable in the electrolysis for recovering gallium without any limitation. In general, an electrolysis is conducted at the electrolyte temperature of 30°–80° C., a current density of 0.01–1 A/cm$^2$ and a current concentration of 1–100 A/l, using stainless steel or some other known solid metal as an electrode. Further, it is preferable from the viewpoint of prevention of explosions due to mixing of oxygen and hydrogen, and prevention of disruption of the oxidation-reduction cycle by inhibitors during the electrolytic deposition of gallium, to separate an anode and a cathode by means of a diaphragm made of unglazed pottery, porous ceramic, porous organic polymer, etc.

Further, the rate of electrolytic deposition of gallium is raised and current efficiency is improved by adding Zn, Sn, Pb, etc. to make its concentration lower than that of gallium prior to the start of the electrolysis.

The spent liquor after the electrolytic treatment can be recycled to the Bayer process as a circulating sodium aluminate solution.

Though only use of seed crystals of inorganic matters such as phosphorus and vanadium in the removal step of the impurities of the present invention is described above, it is possible to use crystals of sodium oxalate as a seed together with said seed crystals. However, even in such a case the oxidation process should not be omitted.

An embodiment of the present invention is explained more specifically referring to the attached single FIGURE which shows a process block diagram containing the wet oxidation treatment with use of a copper catalyst. The simple FIGURE is for exemplification of the present invention, and the scope of the present invention should not be limited thereto.

The single FIGURE is a block diagram showing a process for production of gallium by electrolysis according to the present invention. In the FIGURE, each numeral has the following meaning:

1 aluminuous ores (bauxite),
2 digestion step,
3 red mud separation step,
4 aluminum hydroxide precipitation step,
5 aluminum hydroxide separation step,
6 evaporation step 7 inorganic impurity removal step,
8 wet oxidation step,
9 catalyst recovery step,
10 causticization step,
11 a storage tank for compound offering copper ion,
12 evaporation step,
13 Deposition step of gallium by electrolysis.

First, a circulating sodium aluminate solution (spent liquor) after the evaporation step 6 is introduced to the inorganic impurity removal step 7, where a sodium salt of inorganic matters such as phosphorus and vanadium is added as a seed to the solution to precipitate inorganic impurities. The precipitation is removed from the system, and the resulting aluminate solution is introduced to the wet oxidation step 8. A cupric salt, or a cupric sulfide slurry, which is obtained in the catalyst recovery step 9, as it is or after being subjected to oxidation at an oxidation step (not shown in the drawing) using molecular oxygen, a molecular oxygen-containing gas such as air, etc. to convert the cupric sulfide to cupric sulfate, is introduced to the oxidation step 8. In the step 8, the aluminate solution is contacted with oxygen or the oxygen-containing gas at given high temperature and high pressure, whereby organic matters in the solution are oxidized. Contact time varies somewhat depending upon the content of organic matters in the solution; and is 30 minutes or more in general.

After the treatment the aluminate solution is introduced to the catalyst recovery step 9, where a sulfide is added to the solution to precipitate cupric ion in the solution as cupric sulfide. The precipitate is removed and the resulting aluminate solution is introduced to the causticization step 10. The cupric sulfide as the precipitate is, if necessary, introduced to the wet oxidation step 8 for reuse. A caustic alkaline earth material, such as calcium hydroxide, is added to the spent liquor at the causticization step 10, whereby the carbonate and sulfate in the liquor are converted to insoluble matters such as calcium carbonate and calcium sulfate. After the removal of the insoluble matters by filtration, the filtrate is introduced to the evaporation step 12 where gallium concentration is increased, and then to the electrolytic deposition step 13 where metallic gallium is produced. After the electrolytic treatment the sodium aluminate solution is recycled to the Bayer process as a circulating sodium aluminate solution (spent liquor).

After the oxidation step 8 it is preferable to conduct the evaporation step 12 from the viewpoint of energy economy.

According to the present invention thus described in detail, gallium can be produced efficiently and without any special treatment except that certain purification methods, among various known methods for purifying a circulating sodium aluminate solution, are conducted for the purpose of increasing the purity and precipitation efficiency of the formed aluminum hydroxide. Moreover, according to the present invention the aluminate solution after gallium extraction can be recycled to the Bayer process as a spent liquor. Thus, the present invention has great industrial significance.

The present invention is further described in detail below according to an example, which is not, however, limitative of the present invention.

In the example, the concentration of organic matters is shown in terms of carbon content by elementary analysis.

EXAMPLE

A spent liquor after the evaporation step of the Bayer process containing 161 g/l $Na_2O$, 68 g/l $Al_2O_3$, 0.36 g/l V, 0.17 g/l P and 19.4 g/l organic matters was used in this example. The liquor was treated as follows and subjected to electrolysis using stainless steel as a cathode under a current density of 0.1 A/cm$^2$ at a temperature of 50° C. for 10 hours. The results are shown in Table.

Sample-1 The spent liquor was cooled to 40° C., sodium salt crystals of inorganic matters containing 10 g/l $2Na_3VO_4.NaF.19H_2O$ and 5 g/l $2Na_3PO_4.NaF.19H_2O$ were added thereto as a seed, the mixture was stirred for 12 hours, and then the resulting precipitate was removed, whereby a spent liquor 1 for electrolysis was obtained.

Sample-2 The spent liquor was cooled to 40° C., the sodium salt crystals of inorganic matters in the same amount as that of Sample-1 and 10 g/l sodium oxalate crystals were added thereto, the mixture was stirred for 12 hours, and the resulting precipitate was removed, whereby a spent liquor 2 for electrolysis was obtained.

Sample-3 The spent liquor is cooled to 40° C., the sodium salt crystals of inorganic matters in the same amount as that of Sample-1 and 10 g/l active carbon powder, Shirasagi-C (made by Takeda Chemical Industries, Ltd. Japan) were added thereto, and the mixture was stirred for 12 hours, and the resulting precipitate was removed by solid-liquid separation, whereby a spent liquor 3 for electrolysis was obtained.

Sample-4 The spent liquor treated in the same manner as in Sample-1 was introduced in an autoclave made of nickel, 0.5 g/l copper is added thereto as cupric sulfate, the mixture was kept under an air pressure of 50 kg/cm$^2$ at 260° C. for one hour, sodium sulfide in an amount 3 times the equivalent to the added cupric salt is added thereto, the mixture was stirred at 60° C. for 20 minutes, and then the resulting precipitate was removed, whereby a spent liquor 4 for electrolysis was obtained.

Sample-5 The spent liquor was subjected to the wet oxidation treatment in the same manner as in Sample-4, $Ca(OH)_2$ in an amount equivalent to the carbonate in the liquor was added thereto, the mixture was subjected to causticization at 80° C. for one hour, the resulting precipitation was removed, the same sodium salt crystals of inorganic matters as used in Sample-1 was added thereto and the mixture was stirred at 25° C. for 12 hours, and the resulting precipitation was removed, whereby a spent liquor 5 for electrolysis was obtained.

Sample-6 $Ca(OH)_2$ in an amount equivalent to the carbonate in the spent liquor after the same treatments as in Sample-4 was added to the liquor, the mixture was stirred at 80° C. for one hour for causticization, the resulting precipitation was removed, and then the resulting liquor was evaporated to one-half of the original volume, cooled to 50° C. and then subjected to solid-liquid separation, whereby a spent liquor 6 for electrolysis was obtained.

Sample-7 Aluminum hydroxide as a seed was added to the sodium aluminate solution after the sodium sulfide treatment in the method of Sample-6, that is, before the causticization treatment, to make its concentration to 200 g/l. The mixture was stirred at 50° C. for one day and the resulting precipitate was removed. The resulting liquor was subjected to the causticization treatment and evaporation treatment in the same manner as in Sample-6, whereby a spent liquor 7 for electrolysis was obtained.

Sample-8 The spent liquor treated in the same manner as in Sample-1 was introduced in an autoclave made of nickel. Then, 0.5 g/l copper was added thereto as cupric sulfate, and the mixture was stirred under an air pressure of 50 kg/cm$^2$ at 260° C. for one hour. The resulting solutuion was evaporated to one-half of the original volume and cooled to 60° C. Sodium sulfide in an amount 3 times the equivalent to the added cupric salt was added to the solution, the mixture was stirred for 20 minutes, $Ca(OH)_2$ in an amount equivalent to the carbonate salt in the mixture was added thereto, and the resulting mixture was stirred at 80° C. for one hour for causticization and subjected to solid-liquid separation, whereby a spent liquor 8 for electrolysis was obtained.

Sample-9 The same procedure as in Sample-8 was repeated except that no cupric sulfate was added in the oxidation treatment step and no sodium sulfide was added, either, whereby a spent liquor 9 for electrolysis was obtained.

Sample-10 The spent liquor as it is, that is, that after the evaporation step, was used as a spent liquor 10 for electrolysis.

TABLE

| Example No. | Initial gallium concentration in the electrolyte (g/l) | Gallium concentration after the electrolysis (g/l) | Current efficiency (%) |
|---|---|---|---|
| Sample - 1 | 0.20 | 0.20 | 0 |
| 2 | 0.20 | 0.20 | 0 |
| 3 | 0.20 | 0.20 | 0 |
| 4 | 0.21 | 0.09 | 0.09 |
| 5 | 0.21 | 0.06 | 0.12 |
| 6 | 0.50 | 0.21 | 0.23 |
| 7 | 0.51 | 0.11 | 0.31 |
| 8 | 0.51 | 0.22 | 0.22 |
| 9 | 0.52 | 0.28 | 0.18 |
| 10 | 0.19 | 0.19 | 0 |

What is claimed is:

1. A process for producing metallic gallium from a gallium-containing alkali aluminate solution circulating in the Bayer process, comprising:

(a) removing inorganic impurities from the alkali aluminate solution by cooling the solution after the aluminum hydroxide separation step in the Bayer process, thereby precipitating crystals of the inorganic impurities, and thereafter removing the precipitate from the solution;

(b) removing organic impurities from the alkali aluminate solution by means of an oxidation treatment; and (c) subjecting the purified alkali aluminate solution thus obtained to electrolysis.

2. The process of claim 1, further comprising adding at least one alkali salt, or complex containing an alkali salt, of an element selected from the group consisting of vanadium and phosphorus to the alkali aluminate solution subsequent to the cooling of the solution, thereby enhancing the removal of inorganic impurities from the solution.

3. The process of claims 1 or 2, further comprising subjecting the alkali aluminate solution to causticization treatment after the oxidation treatment.

4. The process of claim 6 wherein the oxidation treatment of the alkali aluminate solution comprises:

(a) subjecting the circulating alkali aluminate solution to catalytic oxidation in the presence of copper ions at a temperature of 180° to 350° C. under conditions sufficient to keep the solution in a liquid state, using molecular oxygen or a molecular oxygen-containing gas in an amount proportional to the amount of organic matter to be oxidized;

(b) adding a chemical substance capable of reacting with the copper ions to form an insoluble precipitate;

(c) separating the insoluble precipitate and removing it from the alkali aluminate solution.

5. The process of claims 1 or 2, wherein the temperature utilized during the cooling of the solution is in the range of 10° to 60° C.

* * * * *